324-77 SR
12/7/82 XR 4,362,995

United States Patent [19]

Morris

[11] 4,362,995

[45] Dec. 7, 1982

[54] METHOD OF AND APPARATUS FOR PRODUCING A LOGARITHMIC REPRESENTATION OF AN INPUT VOLTAGE

[75] Inventor: Darryl C. Morris, Concord, N.H.

[73] Assignee: Northern Telecom, Inc., Nashville, Tenn.

[21] Appl. No.: 110,475

[22] Filed: Jan. 8, 1980

[51] Int. Cl.[3] ..... G06G 7/24

[52] U.S. Cl. ..... 328/145; 307/490; 307/492; 328/144; 324/77 F

[58] Field of Search ..... 307/492, 169; 328/144, 328/145, 22, 123; 324/77 A, 77 F; 364/722, 857

[56] References Cited

U.S. PATENT DOCUMENTS

| | | | |
|---|---|---|---|
| 3,805,046 | 4/1974 | Magnussen, Jr. | 364/857 |
| 3,965,418 | 6/1976 | Bauer et al. | 324/123 R |
| 4,041,299 | 8/1977 | Miyakawa | 328/145 |
| 4,046,999 | 9/1977 | Katsuoka et al. | 328/145 |

*Primary Examiner*—Stanley D. Miller
*Assistant Examiner*—B. P. Davis
*Attorney, Agent, or Firm*—Spencer & Kaye

[57] ABSTRACT

An input voltage is converted into a logarithmic representation thereof by exponentially changing the charge of a capacitor, producing pulses at a rate dependent upon the time taken for the charge to change between the two reference voltages, and counting the pulses during the time taken for the charge to change between the input voltage and a reference voltage, whereby the conversion is independent of the precise time constant governing the exponential change. The pulses can be produced under the control of a phase-locked loop, or by frequency-dividing clock pulses by a count which has been previously established by frequency-dividing the same clock pulse frequency by a predetermined factor. The conversion can be effected rapidly and accurately for input voltages within a relatively large range, without using high-precision components.

10 Claims, 4 Drawing Figures

METHOD OF AND APPARATUS FOR PRODUCING A LOGARITHMIC REPRESENTATION OF AN INPUT VOLTAGE

This invention relates to a method of and apparatus for producing a logarithmic representation of an input voltage. Apparatus of this kind is commonly referred to as a log converter.

In a transmission test set for measuring characteristics of telephone circuits, it is known to measure an alternating voltage on a telephone line using a log converter of the so-called exponential decay type. In such a converter a capacitance C is initially charged to an input voltage which is to be converted into a logarithmic representation thereof, and is then discharged via a resistance R so that the voltage across the capacitor falls exponentially with a time constant RC. The time taken for the voltage across the capacitance to fall to a reference voltage is determined to provide an indication of the input voltage, relative to the reference voltage, for example in decibels (dB). In such an arrangement the alternating voltage on the line must be rectified and filtered to produce the d.c. input voltage to the log converter, and this is achieved by coupling the line to the input of the log converter via a precision rectifier and smoothing filter.

In order to obtain a desired accuracy of measurement in such an arrangement, it has been necessary to use high-precision, and consequently expensive, components in the log converter to provide fixed and stable values of resistance R and capacitance C, because the measured value is directly dependent upon the time constant RC. Even using such components, it is necessary to recalibrate the log converter periodically, and the dynamic range of the log converter within which accurate measurements can be taken is limited, typically to about 10 dB, and to about 14 dB at the most, for an accuracy of ±0.05 dB. As it is desirable to make measurements of the alternating voltage within a dynamic range of about 60 dB,.it is necessary to connect the line to the precision rectifier, and thence to the log converter, via an autoranging amplifier having a relatively large number of autorange steps. The provision of this autoranging amplifier adds to the complexity and cost of the arrangement and constitutes a further source of possible measurement error.

Accordingly, an object of this invention is to provide an improved method of and apparatus for producing a logarithmic representation of an input voltage.

More particularly, this invention seeks to provide an improved so-called log converter which avoids the need to use high-precision components, obviates the need for periodic recalibration, due to changes of the value of the time constant, and has an increased dynamic range without sacrificing conversion accuracy, thereby enabling the autoranging amplifier in the measurement arrangement described above to be considerably simplified.

In accordance with the method and apparatus of this invention, the charge of a capacitor is exponentially changed, and pulses are produced at a pulse rate which is dependent upon the time taken for the charge of the capacitor to change exponentially with a given time constant between tow reference voltages. In order to provide a logarithmic representation of an input voltage, a signal constituting the logarithmic representation is produced in dependence upon the number of pulses which occur at said pulse rate during the time taken for the charge of the capacitor to change exponentially with said given time constant between the input voltage and a reference voltage.

Conveniently, the last-mentioned reference voltage is one of the two reference voltages, the exponential change of the charge of the capacitor with the given time constant is an exponential discharge of the capacitor through a fixed resistor, and the signal constituting the logarithmic representation is a count of the number of pulses which occur at said pulse rate during the relevant time period.

The invention thus provides a method and apparatus in which a logarithmic measurement of an input voltage is effected which is independent of the precise value of the time constant of the exponential change in capacitor charge. In consequence, high-precision components do not need to be used for the capacitor and resistor, and an increased dynamic range can be achieved without loss of accuracy. For example, a so-called log converter has been constructed in accordance with this invention which realised a dynamic range greater than 25 dB with a measurement accuracy of ±0.05 dB and a resolution of 0.1 dB.

In different embodiments of the invention, the pulses are produced at said pulse rate in different ways.

In one embodiment of the invention, pulses are generated at a first, relatively high, fixed frequency, and are applied to a frequency divider. In a first step the frequency divider divides the pulses at this first frequency by a predetermined factor to produce pulses at a second frequency, which pulses are counted by a counter during the time during which the charge of the capacitor changes exponentially between said two reference voltages. In a subsequent step, the frequency divider divides the pulses at the first frequency by a factor equal to the count reached by the counter in the first step, to produce the pulses at said pulse rate. The predetermined factor conveniently corresponds to a logarithmic representation of one of the two reference voltages relative to the other.

Whilst this embodiment of the invention has the advantage that, except for the capacitor charge and discharge, it operates entirely digitally so that it lends itself to implementation in a single integrated circuit device, it involves the use of a high first frequency, for example 10 MHz, in order to obtain rapid measurements with high accuracy.

In another embodiment of the invention the pulses are produced at said pulse rate by using a variable frequency oscillator which, for the same accuracy and speed of measurement, can operate at a much lower frequency, for example around 100 kHz. In this embodiment the frequency of the oscillator is controlled so that a predetermined number of the pulses are produced during the time taken for the charge of the capacitor to change exponentially between the two reference voltages. Again in this case, the predetermined number conveniently corresponds to a logarithmic representation of one of the two reference voltages relative to the other.

In cases where the logarithmic representation of the input voltage is provided as a count established in a counter it is desirable to arrange for the counting by the counter to be offset by half of one count. This conveniently provides a measurement accuracy of plus or minus half of the resolution, for example a measurement accuracy of ±0.05 dB with a resolution of 0.1 dB. The offsetting is simply achieved for example by offsetting the start of the discharge of the capacitor, by one half of the period of the pulses which are counted by the counter to produce the count constituting the logarithmic representation, in relation to the counting by the counter.

The invention will be further understood from the following description of preferred embodiments thereof with reference to the accompanying drawings, in which:

FIG. 1 illutrates, partly in schematic form and partly in block diagram form, a circuit of apparatus in accordance with a first embodiment of the invention;

Figure 1:
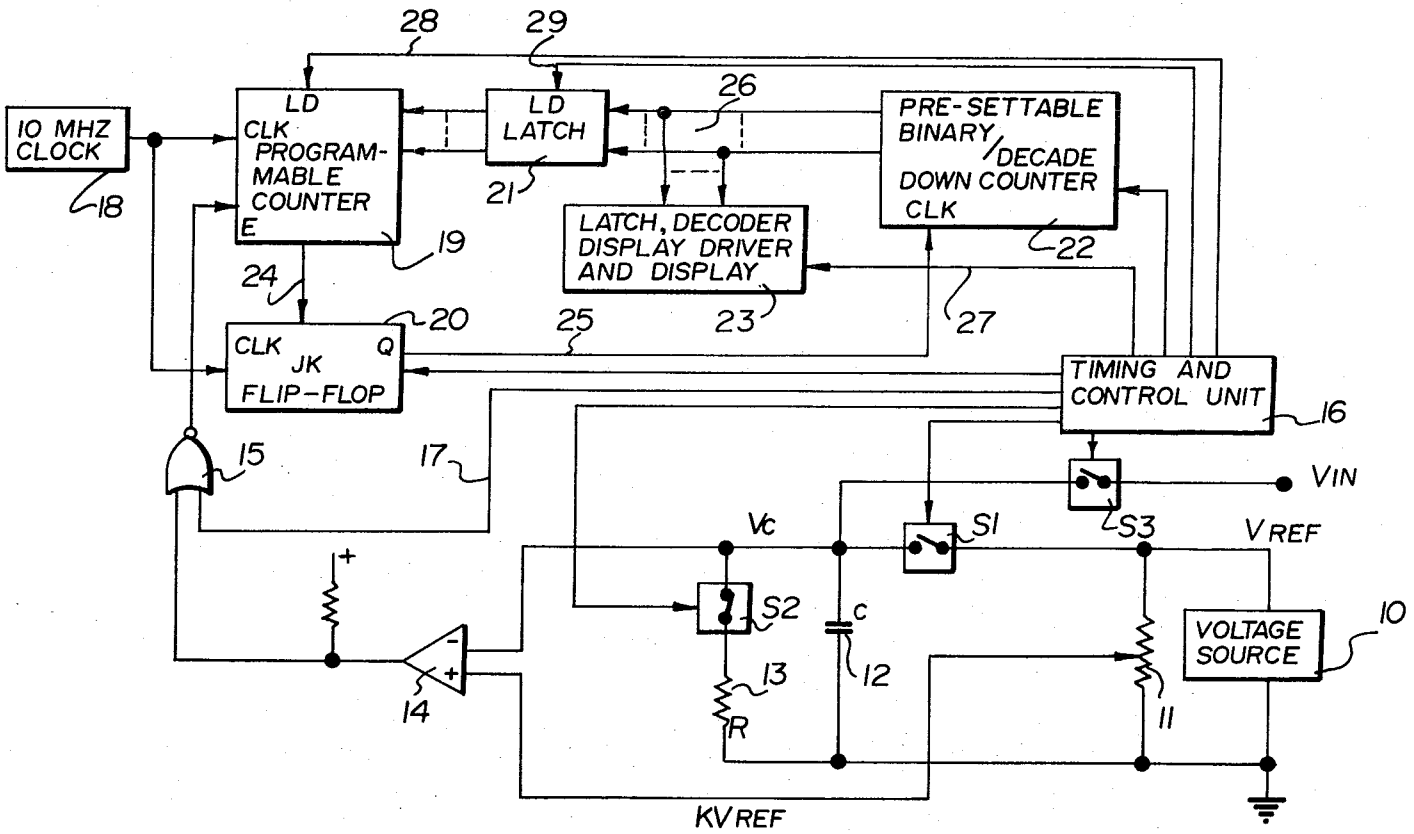
Figure 2:
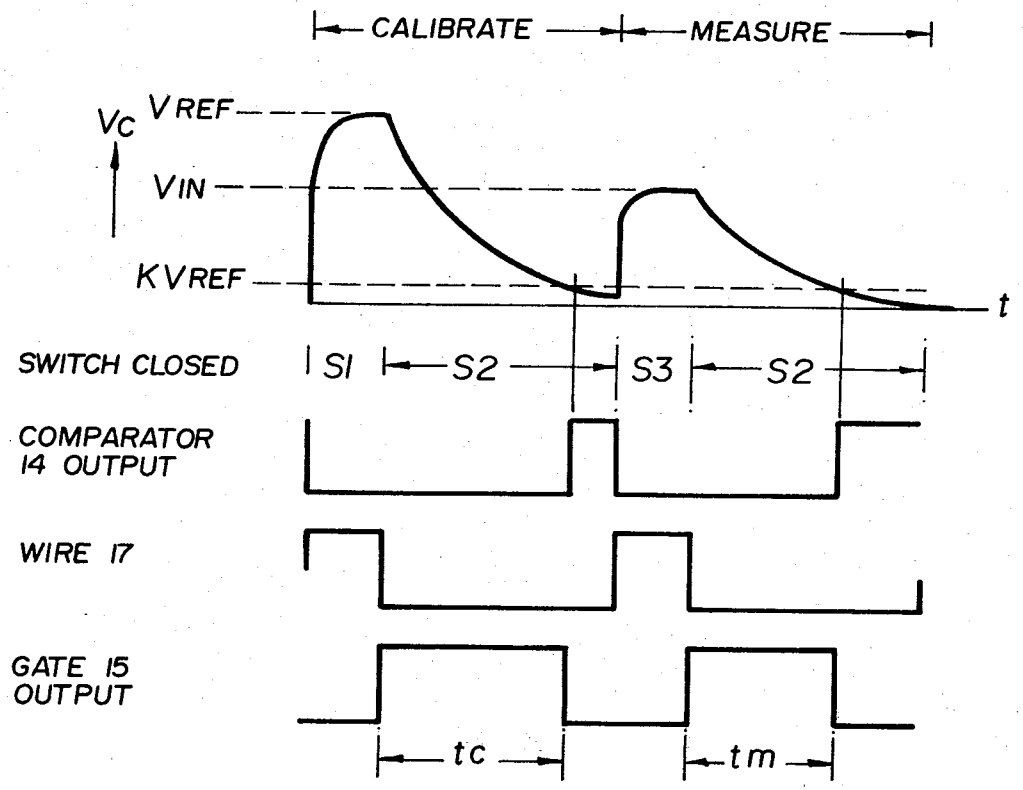
FIG. 2 illustrates a timing diagram relating to the operation of the apparatus illustrated in FIG. 1.

Referring to FIGS. 1 and 2, a first embodiment of the invention will be described in which the conversion of an input voltage Vin into a logarithmic representation thereof is accomplished in two consecutive steps, referred to herein as the calibrate and measure steps, which together form a cycle which is repeated for consecutive logarithmic conversions of the input voltage Vin. It is assumed that Vin lies in a range between a reference voltage Vref and a fraction KVref of this reference voltage. For example, Vref may be 10 volts and KVref may be 1 volt, Vin lying anywhere within the 20 dB range between these voltages which range is the dynamic range of the apparatus, referred to below as a log converter.

The log converter illustrated in FIG. 1 includes a stable voltage source 10 which produces the reference voltage Vref, a potential divider 11 to which the reference voltage is applied and which is adjusted to produce at its tapping point the fraction KVref, a capacitor 12 having a fixed capacitance C, a resistor 13 having a fixed resistance R, switches S1, S2, and S3, a comparator 14, a two-input NOR gate 15, and a timing and control unit 16 which controls operation of the switches S1 to S3 and is also connected via a wire 17 to one input of the NOR gate 15.

The unit 16 controls the switches S1 to S3 so that at any instant one switch is closed and the other two are open. As illustrated in FIG. 2, in the initial, calibrate step in each cycle firstly the switch S1 is closed to connect the capacitor 12 to the voltage source 10, whereby the capacitor 12 is rapidly charged and the voltage Vc across it rises to the reference voltage Vref. The switch S1 is then opened and the switch S2 is closed to connect the resistor 13 in parallel with the capacitor 12, whereby the capacitor 12 discharges and its voltage Vc falls exponentially with time t, with a time constant RC. In the subsequent, measure, step in each cycle the switch S3 is closed, the switch S2 being opened, to connect the capacitor 12 to the input voltage Vin whereby the capacitor 12 is rapidly charged to the voltage Vin, and then the switch S3 is opened and the switch S2 closed to discharge the capacitor 12 as in the calibrate step, with the same time constant RC.

The voltages Vc and KVref are applied respectively to the inverting and non-inverting inputs of the comparator 14, whose output is connected to the other input of the NOR gate 15. FIG. 2 shows the comparator 14 output signal, which goes high when the capacitor voltage Vc crosses the voltage KVref during each discharge of the capacitor, and goes low when the capacitor 12 is next charged to the reference voltage Vref or the input voltage Vin. FIG. 2 also shows the signal which the unit 16 produces on the wire 17, which signal is low whenever the switch S2 is closed, i.e. during each discharge of the capacitor 12, and is high during each charge of the capacitor. In consequence, the gate 15 produces at its output a signal which is also shown in FIG. 2 and which is high for a period tc during the calibrate step, during which period the voltage Vc falls exponentially from Vref to KVref, and is high for a period tm during the measure step, during which period the voltage Vc falls exponentially with the same time constant from Vin to KVref.

It should be appreciated from the above description that the period tc corresponds to the known dynamic range of the log converter between the voltages Vref and KVref, in this case 20 dB, whereas the period tm corresponds to the logarithmic value within this range of the input voltage Vin. The remainder of the log converter illustrated in FIG. 1 is controlled in accordance with the periods tc and tm to provide a logarithmic representation in digital form of the input voltage Vin, which is independent of the precise value of the time constant RC.

The remainder of the log converter of FIG. 1 comprises a clock pulse generator 18, a programmable binary counter 19, a JK flip-flop 20, a latch 21, a presettable binary/decade down counter 22 and a latch, decoder, display driver, and display unit 23. The counter 19 and latch 21 together constitute a programmable frequency divider. The flip-flop 20 acts as a ÷2 circuit and is provided for a purpose which is explained later. Various control signals are supplied from the timing and control unit 16 to the units 19 to 23, the purpose of which signals will be clear from the following description.

The clock pulse generator 18 produces clock pulses, in this example at a frequency of about 10 MHz, which are applied to clock inputs Clk of the counter 19 and flip-flop 20. The output of the NOR gate 15 is connected to an enable input E of the counter 19, and when enabled during the periods tc and tm the counter 19 repeatedly counts the 10 MHz clock pulses to produce a frequency-divided clock signal on an output line 24 which is connected to an input of the flip-flop 20, which further frequency-divides this signal by a factor of 2 to produce a final frequency-divided clock signal at its output Q which is connected via a line 25 to a clock input of the counter 22. Count outputs of the counter 22 are connected via parallel lines 26 to data inputs of the unit 23 and to data inputs of the latch 21, whose outputs are connected to preset data inputs of the counter 19.

In each cycle, the unit 16 sets the counter 22 to count in a binary mode during the calibrate step and in a decade mode during the measure step. At the start of the calibrate step in each cycle, during the time that the switch S1 is closed, the timing and control unit 16 initially enables the unit 23 via a wire 27 to latch the data on the lines 26 for display, this data constituting the logarithmic measurement effected in the preceding cycle. The unit 16 then resets the flip-flop 20 and simultaneously loads the binary equivalent of 200, this corresponding to the 20.0 dB dynamic range of the converter, into the latch 21 and the counter 19. This loading is accomplished by enabling signals supplied from the unit 16 via wires 28 and 29 to load inputs LD of the units 19 and 21 respectively, with the unit 16 simultaneously presetting the counter 22 to the binary equivalent of 200. The unit 16 then terminates the enabling signals on the wires 28 and 29 and presets the counter 22 to a count of zero. These steps are all completed before the switch S1 is opened.

When the switch S1 is opened and the switch S2 is closed, the output of the gate 15 enables the counter 19 to divide the clock pulses supplied to it by the preset factor of 200. The further divided pulses are produced by the flip-flop 20 on the line 25 throughout the period tc, and are counted down in binary in the counter 22 to produce a binary count X. The voltage Vc falls below KVref before the switch S2 is opened. When the switch S2 is opened and the switch S3 is closed, the unit 16 produces enabling signals on the wires 28 and 29 to load the binary count X into the latch 21 and counter 19, and simultaneously sets the flip-flop 20. After terminating these enabling signals, the unit 16 presets the counter 22 to 200 (decade), equivalent to the 20.0 dB dynamic range. These steps occur before the period tm commences. Accordingly, during the period tm the clock pulses from the generator 18 are divided in frequency by the counter 19 by the factor x, and by the flip-flop 20 by the factor 2, and the resultant frequency-divided pulses on the line 25 are counted down from 200 by the counter 22, which is now operating in its decade mode. The resultant count constitutes the desired logarithmic representation of the input voltage Vin, and is latched in and displayed by the unit 23 at the start of the next cycle as already described above. This cycle is repeated for subsequent measurements.

It will be noted that the flip-flop 20 is initially reset in the calibrate step and set in the measure step. This difference provides, in the above example, a bias or offset in the decade counting by the counter 22 which is equivalent to 0.05 dB, providing a rounding of 0.05 dB.

It can be seen that during the capacitor discharge in the calibrate step $$tc = RC \log_e \frac{\text{Vref}}{K\text{Vref}} = RC \log_e \frac{1}{k},$$

and during the discharge in the measure step $$tm = RC \log_e \frac{\text{Vin}}{K\text{Vref}}.$$

Assuming that the total frequency division factor (in the above example, 400) in the calibrate step is Y, the frequency generated by the generator 18 is f, and the accumulated count in the measure step is Z, it can be seen that $$\frac{f}{X} = \frac{Y}{tc} = \frac{Z}{tm}.$$

Substituting for tc and tm gives $$Z = \frac{Y \log_e \frac{\text{Vin}}{K\text{Vref}}}{\log_e \frac{1}{K}} = \frac{Y \log \frac{\text{Vin}}{K\text{Vref}}}{\log \frac{1}{K}}$$

Thus it can be seen that the count Z is a logarithmic representation of the input voltage Vin which is independent of the actual values of R, C, and f, it being assumed that these values are constant during each individual cycle of calibrate and measure steps. As such short-term stability of the resistance R and capacitance C is readily achieved, the capacitor 12 and resistor 13 can be inexpensive relatively low-precision components.

Figure 3:
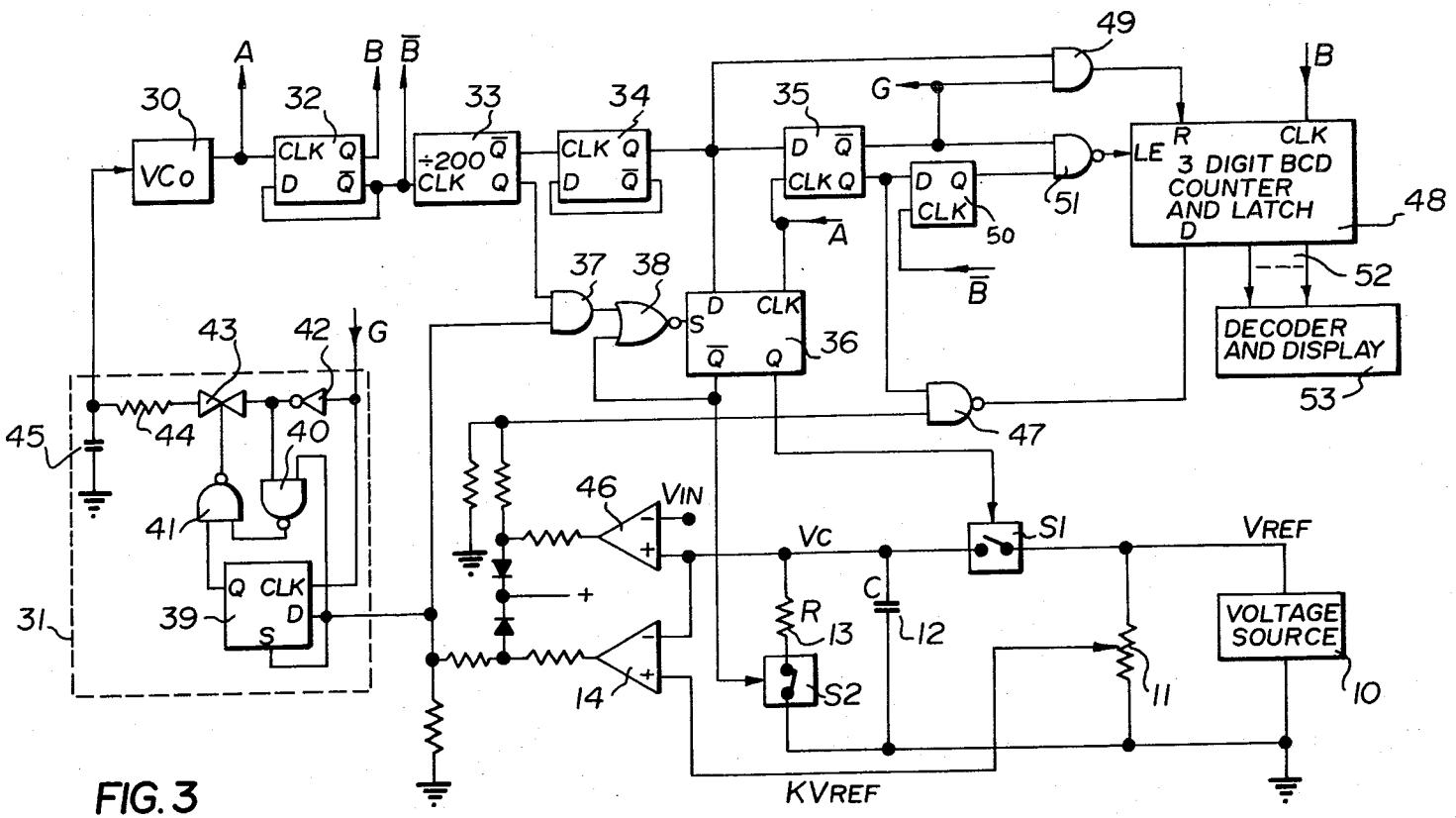
FIG. 3 illustrates, partly in schematic form and partly in block diagram form, a circuit of apparatus in accordance with a second embodiment of the invention.
Figure 4:
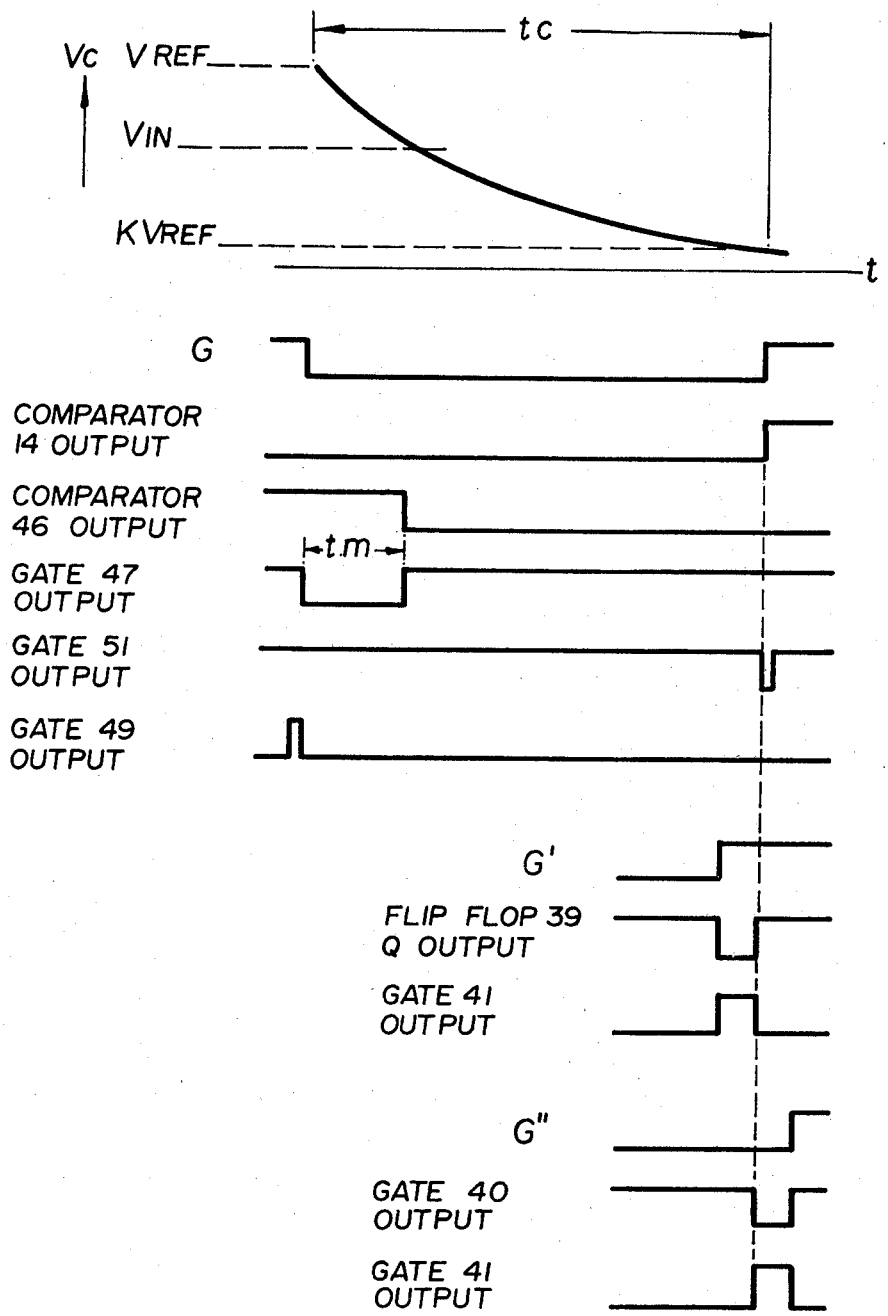
FIG. 4 illustrates a timing diagram relating to the operation of the apparatus illustrated in FIG. 3.

Referring now to FIGS. 3 and 4, a second embodiment of the invention will be described, in which again an input voltage Vin, which lies within a 20 dB range between a reference voltage Vref (for example 10 volts) and a fraction KVref (for example 1 volt) of this reference voltage, is converted into a logarithmic representation thereof. In FIG. 3 the same references as used in FIG. 1 are used to denote similar components.

The log converter illustrated in FIG. 3 includes a voltage-controlled oscillator (VCO) 30 which is controlled by a voltage supplied by a control circuit generally referenced 31 to produce a pulsed signal A at a frequency of about 100 KHz. The signal A is applied to the clock input Clk of a D-type flip-flop 32 whose $\overline{Q}$ output is connected to its D input to form a ÷2 circuit, the flip-flop 32 producing signals B and $\overline{B}$ at its Q and $\overline{Q}$ outputs respectively. The signal $\overline{B}$ is applied to the clock input of a ÷200 frequency divider 33. The frequency division factor of 200 of the divider 33 is selected corresponding to the 20.0 dB dynamic range of the converter.

An output $\overline{Q}$ of the frequency divider 33 is connected to the clock input of a D-type flip-flop 34 whose $\overline{Q}$ output is connected to its D input to form another ÷2 circuit. The Q output of the flip-flop 34 is connected to the D input of each of two D-type flip-flops 35 and 36 the clock inputs of which are supplied with the signal A from the VCO 30. The Q and $\overline{Q}$ outputs of the flip-flop 36 are connected to control inputs of switches S1 and S2, which are controlled so that the switch S1 is open and the switch S2 is closed when the flip-flop 36 is set, whereas the switch S1 is closed and the switch S2 is open when the flip-flop 36 is reset. Thus the switches S1 and S2 are alternately opened and closed as the flip-flop 36 is set and reset.

In a similar manner to that described with reference to FIG. 1, a capacitor 12 is rapidly charged to the reference voltage Vref supplied from a voltage source 10 when the switch S1 is closed, and is discharged via a resistor 13 with a time constant RC when the switch S2 is closed. The exponentially varying voltage Vc of the capacitor is compared with the voltage KVref from a potential divider 11 in a comparator 14.

The output of the comparator 14 is connected to one input of a two-input AND gate 37, the other input of which is connected to the Q output of the ÷200 frequency divider 33. The output of the AND gate 37 and the $\overline{Q}$ output of the flip-flop 36 are connected to the inputs of a NOR gate 38 whose output is connected to a set input S of the flip-flop 36. The output of the comparator 14, and a signal G which is produced at the $\overline{Q}$ output of the flip-flop 35, are supplied as inputs to the control circuit 31 which is more fully described below.

The parts of the log converter of FIG. 3 described above constitute a phase-locked loop in which the VCO 30 is controlled so that the capacitor 12 is alternately charged to the reference voltage Vref and discharged via the resistor R to a voltage which is less than KVref, and so that exactly 200 pulses of the signal B occur during the time taken for the capacitor voltage to fall exponentially from the reference voltage Vref to the voltage KVref. This control is achieved by the control circuit 31, which comprises a D-type flip-flop 39, two-input NAND gates 40 and 41, an inverter 42, a transmission gate 43, a resistor 44, and a storage capacitor 45. The output of the comparator 14 is supplied to the data input D and set input S of the flip-flop 39, and to one input of the NAND gate 40. The signal G is supplied to the clock input of the flip-flop 39 and via the inverter 42 to the other input of the NAND gate 40 and to a signal input of the transmission gate 43. The output of the NAND gate 40 and the Q output of the flip-flop 39 are connected to the inputs of the NAND gate 41, whose output is connected to a control input of the transmission gate 43. An output of the transmission gate 43 is connected via the resistor 44 to the storage capacitor 45, whose stored voltage constitutes the control voltage for the VCO 30.

The operation of the control circuit is illustrated in the timing diagram of FIG. 4, which illustrates the capacitance discharge part of a cycle of operation of the converter of FIG. 3. In the ideal situation, when the frequency of the VCO 30 is such that exactly 200 periods of the signal B equal the period tc taken for the capacitor 12 to discharge exponentially with the time constant RC from Vref to KVref, then the signal G goes high at exactly the same time as the output of the comparator 14, as shown in the upper half of FIG. 4. In this situation the outputs of the flip-flop 39 and the gate 40 are both initially high and remain high, so that the output of the gate 41 is continuously low and the transmission gate 43 is maintained open circuit. Consequently there is no change in the control voltage stored by the capacitor 45 and no change in the frequency of the VCO 30.

If the frequency of the VCO 30 is too high relative to the time constant RC, then the signal G takes the form of a signal G′ shown in the lower half of FIG. 4, going high before the output of the comparator 14 goes high. In this case the positive-going edge of the signal G′ and simultaneous low level of the comparator 14 output reset the flip-flop 39, which is set again when the comparator 14 output goes high. The output of the gate 40 is continuously high. Consequently the output of the gate 41 goes high, and renders the transmission gate 43 conductive, for a short period which is dependent upon the degree of relative error of the frequency of the VCO 30. During the conductive period of the transmission gate 43 the output of the inverter 42 is low, and this low level reduces the voltage to which the capacitor 45 is charged and hence reduces the frequency of the VCO 30.

Conversely, if the VCO frequency is too low the signal G takes the form of a signal G″ in FIG. 4, which goes high later than the output of the comparator 14. In this case the flip-flop 39 remains set whereas the output of the gate 40 goes low for a short period, rendering the output of the gate 41 high and the transmission gate 43 conductive. The output of the inverter 42 is in this case high while the gate 43 is conductive, so that the voltage to which the capacitor 45 is charged, and hence the VCO frequency, is increased.

In the log converter of FIG. 3, unlike that of FIG. 1, the input voltage Vin is applied to the inverting input of a second comparator 46, to whose non-inverting input the capacitor voltage Vc is applied. The output of the comparator 46 is connected to one input of a two-input NAND gate 47, to the other input of which the Q output of the flip-flop 35 is connected. The output of the NAND gate 47 is connected to a disable input D of a 3 digit binary-coded-decimal counter and latch 48, to a clock input Clk of which the signal B is supplied. The Q output of the flip-flop 34 and the $\overline{Q}$ output of the flip-flop 35 are connected to the inputs of an AND gate 49 whose output is connected to a resetting input R of the counter and latch 48. The Q output of the flip-flop 35 is connected to the D input of a D-type flip-flop 50 whose clock input is supplied with the signal $\overline{B}$. The Q output of the flip-flop 50 and the $\overline{Q}$ output of the flip-flop 35 are connected to the inputs of a NAND gate 51 whose output is connected to a latch enable input LE of the counter and latch 48. Outputs of the latch part of the counter and latch 48 are connected via parallel data lines 52 to inputs of a decoder and display unit 53.

FIG. 4 also illustrates the operation of this part of the log converter of FIG. 3. As can be seen from FIG. 4, immediately before the start of a discharge of the capacitor 12 is high level is produced at the output of the gate 49 to reset the counter part of the counter and latch 48. During a period tm, in which the capacitor voltage Vc falls exponentially with the time constant RC from Vref to Vin, the output of the gate 47 is low to allow the counter part of the counter and latch 48 to count pulses of the signal B. When the signal G goes high the output of the gate 51 goes low for a short period, and then goes high again, to enable the latch to store the count reached by the counter. The stored count is decoded and displayed by the unit 53.

It can be seen that if the input voltage Vin is equal to the reference voltage Vref, then the periods tc and tm will be equal and the counter and latch 48 will count and store all 200 pulses of the signal B which occurs during the period tc. This count will be decoded and displayed as 20.0 dB by the unit 53. Thus in this embodiment the input voltage Vin is converted into a logarithmic value relative to the level KVref.

It is observed that in FIG. 3 the flip-flops 35 and 36 are set, and hence the counter is enabled via the gate 47, at the start of the discharge of the capacitor 12, by a pulse of the signal A, whereas the counter part of the counter and latch 48 actually counts pulses of the signal B. This difference provides a desired bias or offset in the counting equivalent to 0.05 dB, providing a rounding of 0.05 dB.

It can again for this embodiment be shown mathematically that the converted representation of the input voltage Vin is a logarithmic representation which is independent of the actual value of the time constant RC, so that again high-precision components need not be used for the capacitor 12 and resistance 13.

By way of example, it is observed that in the FIG. 3 embodiment of the invention the D-type flip-flops can be Motorola type MC14013B devices, the VCO 30 can be a Motorola type MC14046B device, and the counter and latch 48 can be a Motorola type MC14553B device. The ÷200 frequency divider 33 can comprise a Motorola type MC14518B dual BCD counter, an inverter, and a D-type flip-flop. In both embodiments, the switches can be Siliconix type DG200 and the voltage source 10 can be an Analog Devices type AD581 precision voltage source.

Numerous modifications, variations, and adaptations may be made to the above-described embodiments without departing from the scope of the invention as defined in the claims.

For example, different reference voltages and frequency division factors may be used to provide log converters with different dynamic ranges and resolutions. In addition, the conversion operation can be arranged to take place during exponential charging of the capacitor with a given time constant, rather than during discharging as described above. Furthermore, instead of the pulses which occur during the period tm being counted and displayed, they could be counted and the resultant count transmitted to a remote station via a data link, or some other signal constituting the desired logarithmic representation of the input voltage Vin could be produced in dependence upon the number of pulses which occur during the period tm. For example, such other signal could take the form of a single pulse having a pulse duration which is dependent upon the number of pulses which occur during the period tm.

The embodiments of the invention in which an exclusive property or privilege is claimed are defined as follows:

1. A method of producing a logarithmic representation of an input voltage, comprising the steps of:

exponentially changing the charge of a capacitor;

producing pulses at a pulse rate which is dependent upon the time taken for the charge of the capacitor to change exponentially with a given time constant between two reference voltages; and producing a signal in dependence upon the number of said pulses which occur during the time taken for the charge of the capacitor to change exponentially with said given time constant between said input voltage and a reference voltage, said signal constituting said logarithmic representation.

2. A method as claimed in claim 1 wherein said pulses are produced at said pulse rate by:

generating pulses at a first, relatively high, fixed frequency;

in a first step, frequency-dividing said pulses at said first frequency by a predetermined frequency division factor to produce pulses at a second frequency, and counting the number of pulses at the second frequency which occur during the time during which the charge of the capacitor changes exponentially with said given time constant between said two reference voltages to produce a resultant count; and in a second step, frequency-dividing said pulses at said first frequency by a frequency division factor equal to said resultant control to produce said pulses at said pulse rate.

3. A method as claimed in claim 1 wherein said pulses are produced at said pulse rate by:

generating pulses in dependence upon the output frequency of a variable frequency oscillator; and controlling the frequency of said oscillator so that a predetermined number of said generated pulses are produced during the time taken for the charge of the capacitor to change exponentially with said given time constant between said two reference voltages.

4. A method as claimed in claim 1, 2, or 3 wherein the step of producing said signal comprises counting the number of said pulses at said pulse rate which occur during the time taken for the charge of the capacitor to change exponentially with said given time constant between said input voltage and said reference voltage to provide a count constituting said logarithmic representation.

5. Apparatus for producing a logarithmic representation of an input voltage, comprising:

means for exponentially changing the charge of a capacitor;

means responsive to the charge of the capacitor for producing pulses at a pulse rate which is dependent upon the time taken for the charge of the capacitor to change exponentially with a given time constant between two reference voltages; and means for producing a signal, constituting said logarithmic representation, in dependence upon the number of said pulses which occur during the time taken for the charge of the capacitor to change exponentially with said given time constant between said input voltage and a reference voltage.

6. Apparatus as claimed in claim 5 wherein said means for exponentially changing the charge of the capacitor is arranged to change the charge of the capacitor exponentially with said given time constant between said two reference voltages in a first step, and between said input voltage and said reference voltage in a second step, and wherein said means for producing pulses comprises:

means for generating pulses at a first, relatively high, fixed frequency;

frequency-dividing means;

counting means; and control means, responsive to the charge of the capacitor, for controlling said frequency-dividing means in said first step to frequency-divide the pulses at said first frequency by a predetermined frequency division factor to produce pulses at a second frequency; for controlling said counting means in said first step to count the number of pulses at the second frequency which occur during the time during which the charge of the capacitor changes between said two reference voltages to produce a resultant count, and for controlling said frequency-dividing means in said second step to frequency-divide said pulses at said first frequency by a frequency division factor equal to said resultant count to produce said pulses at said pulse rate.

7. Apparatus as claimed in claim 5 wherein said means for producing pulses comprises:

means, including a variable frequency oscillator, for generating pulses; and means responsive to the charge of the capacitor for controlling the frequency of said oscillator so that a predetermined number of said generated pulses are produced during the time taken for the charge of the capacitor to change exponentially with said given time constant between said two reference voltages.

8. Apparatus for producing a logarithmic representation of an input voltage, comprising:

a capacitor;

a resistor;

means for providing first and second reference voltages between which the input voltage lies;

means for sequentially charging the capacitor to the first reference voltage, discharging the capacitor through the resistor to at least the second reference voltage, charging the capacitor to the input voltage, and discharging the capacitor through the resistor to at least the second reference voltage;

a pulse generator for generating pulses at a first fixed frequency;

a programmable frequency divider arranged when enabled to frequency-divide the pulses at said first frequency to produce frequency-divided pulses;

a counter for counting said frequency-divided pulses; and control means responsive to the charge of the capacitor for controlling the frequency divider;

said control means being arranged to program the frequency divider, during charging of the capacitor to the first reference voltage, to frequency-divide by a factor corresponding to a logarithmic representation of the first reference voltage relative to the second reference voltage, to enable the frequency divider during discharge of the capacitor from the first reference voltage to the second reference voltage, whereby the frequency divider produces frequency-divided pulses at a second frequency which pulses are counted by the counter to produce a resultant count, to program the frequency divider, during charging of the capacitor to the input voltage, to frequency-divide by a factor equal to the resultant count and to reset the counter, and to enable the frequency divider during discharge of the capacitor from the input voltage to the second reference voltage, whereby the frequency divider produces frequency-divided pulses which are counted by the counter to produce a further resultant count which constitutes said logarithmic representation of the input voltage.

9. Apparatus for producing a logarithmic representation of an input voltage, comprising:

a capacitor;

a resistor;

means for providing first and second reference voltages between which the input voltage lies;

a variable frequency oscillator for generating pulses;

a frequency divider arranged to frequency divide the generated pulses by a predetermined factor corresponding to a logarithmic representation of the first reference voltage relative to the second reference voltage to produce frequency-divided pulses;

means for alternately charging the capacitor to the first reference voltage and discharging the capacitor through the resistor to at least the second reference voltage in dependence upon the frequency-divided pulses;

means for controlling the frequency of the oscillator, in dependence upon the frequency-divided pulses and the discharge of the capacitor, so that the oscillator produces a number of said generated pulses equal to said predetermined factor during discharge of the capacitor from the first reference voltage to the second reference voltage; and means including a counter for counting the number of said generated pulses which are produced during discharge of the capacitor from the first reference voltage to the input voltage to produce a resultant count which constitutes said logarithmic representation of the input voltage.

10. Apparatus as claimed in claim 8 or 9 and including means for offsetting the counting by the counter to produce the count which constitutes the logarithmic representation of the input voltage, by half of one count.

* * * * *